US006244901B1

(12) United States Patent
Fujii et al.

(10) Patent No.: US 6,244,901 B1
(45) Date of Patent: Jun. 12, 2001

(54) CONNECTOR AND CONNECTION METHOD

(75) Inventors: Masayasu Fujii; Yukimasa Motomatsu, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/388,107

(22) Filed: Sep. 1, 1999

(30) Foreign Application Priority Data

Sep. 7, 1998 (JP) ..... 10-252861

(51) Int. Cl.[7] ..... H01R 13/40
(52) U.S. Cl. ..... 439/596; 439/595
(58) Field of Search ..... 439/595, 747, 439/596, 871, 598–599, 14, 592, 594

(56) References Cited

U.S. PATENT DOCUMENTS

| | | | | |
|---|---|---|---|---|
| 4,272,879 | | 6/1981 | Wigby et al. . | |
| 5,232,373 | * | 8/1993 | Sawada | 439/140 |
| 5,562,495 | * | 10/1996 | Kakitani et al. | 439/595 |
| 5,664,967 | | 9/1997 | Hatagishi et al. . | |
| 5,713,756 | | 2/1998 | Abe . | |

FOREIGN PATENT DOCUMENTS

| | | |
|---|---|---|
| 0 333 394 A2 | 9/1989 | (EP) . |
| 6-34367 | 5/1994 | (JP) . |
| 6-260258 | 9/1994 | (JP) . |
| 8-88031 | 4/1996 | (JP) . |

* cited by examiner

*Primary Examiner*—Brian Sircus
*Assistant Examiner*—J. F. Duverne
(74) *Attorney, Agent, or Firm*—Anthony J. Casella; Gerald E. Hespos; Michael J. Porco

(57) ABSTRACT

To provide a connector is provided in which insulated portions of wires can be securely connected with the terminal fittings mounted in a connector housing. A main body 2 of a housing 1 is integrally provided with a cover 43 via a hinge 17 at its rear end. When terminal fittings 7 are mounted in the housing 1 with the cover 43 in its open position, insulation barrels 40 of the terminal fittings 7 are exposed. Wires 19 are connected with the insulation barrels 40 by moving a crimper 42 and an anvil 41 from above and below, respectively, thereby securing the wires 19.

7 Claims, 13 Drawing Sheets

CONNECTOR AND CONNECTION METHOD

BACKGROUND OF THE INVENTION

1. Field of the Invention

The present invention relates to a connector and to a connection method for connecting one or more terminal fittings of a connector with one or more wires.

2. Description of the Related Art

FIGS. 11 to 15 show a prior art connector disclosed in Japanese Examined Patent Publication No. 6(HEI)-34367. The prior art connector of FIGS. 11–15 includes a plurality of terminal fittings 111. Each terminal fitting 111 used in this prior art connector includes female contacts 112 provided at the front end, wire barrels 113 provided in the middle and insulation barrels 114 provided at the rear end. The wire barrels 113 are to be connected to a core 123 of a wire 121 and the insulation barrels 114 are to be connected with an insulation coating 122 of the wire 121. The terminal fittings 111 are mounted in a connector housing 131 (hereinafter, merely "housing 131") as shown in FIG. 11 to form the prior art connector.

The housing 131 of the prior art connector is formed with four cavities 137, in which the terminal fittings 111 are mounted. Further, the upper surface of the housing 131 is cut away from the rear end to a position slightly forward than the middle, thereby forming an opening 133. Openings are made in the rear end surface of the prior art housing 131 to correspond to the respective cavities 137. Further, partition walls 134 are provided at the boundaries between the respective cavities 137.

As shown in FIG. 13, the lower surface of the prior art housing 131 is formed with openings 135 in positions corresponding to the positions of the wire barrels 113 at bottom walls 116 of the terminal fittings 111. An anvil 141 for crimping the wire barrels 113 is insertable through the openings 135. A crimper 142, which crimps the wire barrels 113 in cooperation with the anvil 141, is insertable through the opening 133 in the upper surface of the housing 131.

An anvil 143 for crimping the insulation barrels 114 can be brought into contact with the lower surface of the housing 131 in positions corresponding to those of the insulation barrels 114 of the terminal fittings 111. A crimper 144, which crimps the insulation barrels 114 in cooperation with the anvil 143, is insertable through the opening 133 in the upper surface of the housing 131. The anvils 141, 143 are made integral to each other at their lower parts, whereas the crimpers 141, 142 are made integral to each other at their upper parts. Accordingly, the crimping operation of the anvil 141and the crimper 142 and that of the anvil 143 and the crimper 144 are performed simultaneously by an unillustrated cylinder or like driving source via a toggle mechanism or the like.

To assembly the prior art connector, the housing 131 having the terminal fittings 111 mounted in the cavities 137 is transported to a location where the crimping operation is performed. The wire 121 is brought with the core 123 exposed by peeling the insulation coating 122 by a specified length. The wire 121 is located above the connector in such a state as shown in FIG. 12 (the housing 131 is shown in FIG. 12). If the wire 121 is lowered in this state, the core 123 exposed at the leading end is fitted between the wire barrels 113 and a portion of the wire 121 still covered by the insulation coating 122 is fitted between the insulation barrels 114.

The crimpers 142, 144 are lowered and the anvils 141, 143 are raised by driving an unillustrated driving mechanism in the state shown in FIG. 13. Then, the crimper 142 strikes against the wire barrels 113, and the crimper 144 strikes against the insulation barrels 114. Simultaneously, the anvil 141 strikes against the bottom walls 116 of the terminal fittings 111 through the openings 135 in the lower surface of the housing 131 and the anvil 143 strikes against the lower surface of the housing 131.

By further driving the driving mechanism, the wire barrels 113 of the terminal fittings 111 are crimped by the anvil 141 and the crimper 142 as shown in FIG. 15, thereby holding the cores 123. Although this crimping force is considerably strong, the anvil 141 and the crimper 142 do not break or damage the housing 131 since they act directly on the terminal fittings 111.

Further, the insulation coatings 122 of the wires 121 are held by crimping th insulation barrels 114 of the terminal fittings 111 by the anvil 143 and the crimper 144.

As described above, a floor surface 131A of the housing 131 is left as it is below the insulation barrels 114 and the crimper 144 enters between the partition walls 134. Thus, it becomes extremely difficult to perform the crimping operation if the housing 131 and the terminal fittings 111 are considerably smaller.

The present invention was developed in view of the above problem, and an object thereof is to provide a connector and a connection method in which insulation coatings of wires can be securely connected with the terminal fittings mounted in a connector housing.

SUMMARY OF THE INVENTION

According to the invention there is provided a connector, comprising: terminal fittings each having insulation barrels to be crimped for connection with an insulation coating of a wire. The connector further includes a connector housing formed with a plurality of cavities for accommodating the terminal fittings. Portions of walls of the connector housing, which substantially correspond to the insulation barrels, when the terminal fittings are accommodated in the corresponding cavities of the connector housing, are made open over substantially the entire width of the connector housing to enable the connection of the wires with the insulation barrels of the respective terminal fittings with the terminal fittings accommodated in the corresponding cavities. Thus portions of walls of the connector housing, which are located on access paths of a crimper and/or an anvil for crimping the insulation barrels, are made open over substantially the entire width to avoid interference between the housing and the crimper and/or anvil.

According to a preferred embodiment, there is provided a connector, comprising terminal fittings each having insulation barrels to be crimped for the connection with an insulation coating of a wire, and a connector housing formed with a plurality of cavities for accommodating the terminal fittings. Portions of walls of the connector housing, which are located on access paths of a crimper and an anvil for crimping the insulation barrels, are made open over the entire width of the connector housing to enable the connection of the wires with the insulation barrels of the respective terminal fittings while the terminal fittings are accommodated in the corresponding cavities. Accordingly, when the terminal fittings are first accommodated in the cavities, the insulation barrels are exposed to the outside since the wall portions of the connector housings corresponding to the access paths of the crimper and the anvil are made open over the entire width of the connector housing. Wires can be placed between-the corresponding pairs of insulation barrels. The crimper and the anvil then can be moved into the cavities. Thus, the insulation barrels are directly crimped by the crimper and the anvil for connection with the insulation coatings of the wires.

Since the wall portions of the connector housings corresponding to the access paths of the crimper and the anvil are made open over the entire width of the connector housing, the interference with the crimper and the anvil can be more easily avoided as compared to a connector in which a hole is formed in each cavity for the same purpose. Further, this construction is advantageous when the intervals between the cavities are narrowed, and hence the connector housing can be made smaller.

Preferably, the portions of the connector housing, which are made open so as not to interfere the access paths of the crimper and the anvil, are substantially openable and substantially closable by a cover. The cover may be integrally or unitarily provided in the housing via a hinge. Accordingly, since at least one of the portions made open for the access paths of the crimper and the anvil is closable by the cover integrally provided in the connector housing via the hinge, the connector can be handled more easily and is advantageous in terms of costs since the number of parts is reduced as compared with a connector in which the opened portion is closed by a separate cover.

Further preferably, the cover can be locked by locking means in its substantially closed position.

The connector housing preferably is open over substantially its entire width also in positions corresponding to a connecting portion of the terminal fitting such as blades or a wire barrel to be connected with cores of the wires. Accordingly, the terminal fitting also can be connected to a connector of the core-crimping or press-contact type while accommodated in the connector housing, since such a connector type requires a higher force to bend the wire barrel for connecting the core of a wire with the fitting.

According to the invention, there is further provided a connection method for connecting one or more terminal fittings accommodated in corresponding cavities of a connector with one or more wires. The method comprises exposing insulation barrels of the terminal fittings by opening portions of walls of a connector housing of the connector over substantially the entire width of the connector housing. The opening is in positions substantially corresponding to the insulation barrels when the terminal fittings are accommodated in the corresponding cavities of the connector housing. The method then includes moving a crimper and an anvil towards each other for crimping the insulation barrels to effect the connection of the wires with the insulation barrels of the respective terminal fittings with the terminal fittings accommodated in the corresponding cavities.

According to a preferred embodiment of the invention, the connection method further comprises the step of substantially closing the portions of walls of the connector housing by means of a cover.

Preferably, the method further comprises the steps of exposing a portion of the terminal fittings corresponding to a connecting portion, preferably blades or a wire barrel, thereof by opening at least one portion of the connector housing and effecting the electrical connection between the connecting portions and cores of the wires.

These and other objects, features and advantages of the present invention will become more apparent upon a reading of the following detailed description and accompanying drawings.

DETAILED DESCRIPTION OF THE PREFERRED EMBODIMENT

Figure 1:
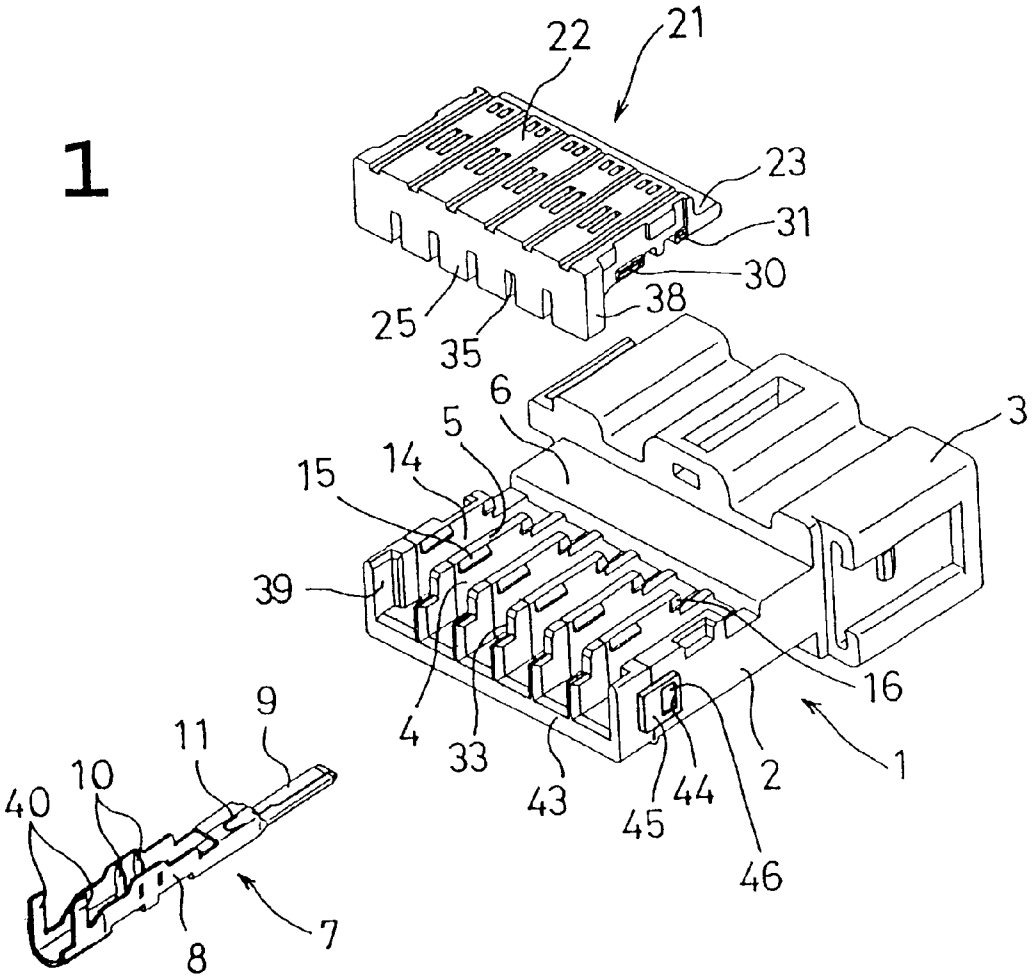
FIG. 1 is an exploded perspective view of a connector according to a first embodiment.

A first embodiment of the invention is described with reference to FIGS. 1 to 9. In this embodiment a male connector 20 of the insulation cutting type is comprised of a connector housing 1, a plurality of male terminal fittings 7 and a lid 21 to be mounted on the housing 1 Each terminal fitting 7 has a main body 8 with an open lateral or upper surface. A tab 9 projects at a leading end of the main body 8. Two pairs of blades 1 preferably are provided substantially in the middle of the main body 8 while being spaced apart by a specified distance along forward and backward directions or an insertion direction of the terminal fitting 7 into the housing 1. When a wire 19 is pushed between these pairs of blades 10, the blades 10 cut an insulation coating 19A of the wire 19 to be brought into contact with a core 19B, thereby establishing an electrical connection between the terminal fitting 7 and the wire 19. Upper parts of the blades 10 are so slanted as to introduce the wire 19 toward the middle.

A pair of insulation barrels 40 project preferably at the left and right sides of the substantially rear end of the main body 8. The insulation barrels 40 preferably are displaced to each other along forward and backward directions. The wire 19 is inserted between the insulation barrels 40 and compressed by an anvil 41 and crimper 42 to be described later to connect the insulation coating 19A of the wire 1 with the insulation barrels 40. A locking portion 11 projects at the upper surface a front part of the main body 8 in such a manner as to be elastically deformable upwardly and downwardly or toward and away from the main body 8. The locking portion 11 is engaged or engageable with an engaging portion 12 provided in the housing 1 to lock the terminal fitting 7 so as not to come out.

The housing 1 is made integrally or unitarily made e.g. of a synthetic resin material, and a hood-shaped connecting portion 3 to be connected with an unillustrated female housing is formed at the front of a substantially flat main body 2. A plurality of cavities 4 extend in forward and backward directions inside the main body 2 and are arranged substantially side by side along the widthwise direction of the main body 2. The terminal fittings 7 are mountable respectively in the cavities 4. The upper surfaces of the respective cavities 4 are substantially closed for a specific (predetermined or predeterminable) distance by a closing portion 6 at a side toward the connecting portion 3, and are substantially open behind the closing portion 6. The respective cavities 4 are partitioned by partition walls 5, which are lower or projecting less than the closing portion 6 over a specified distance at ends of the partition walls 5 toward the closing portion 6. Portions of the partition walls 5 behind these lowered portions are higher or projecting more than the closing portion 6. When the terminal fittings 7 are inserted into the respective cavities 4 from behind, the locking portions 11 engage with the engaging portions 12 on the ceiling surfaces of the cavities 4 to lock the terminal fittings 7 so as not to come out of the cavities 4, and the tabs 9 at least partially project into the connecting portion 3.

At the opposite sides of an upper end of an opening 14 at each cavity 4, long and short locking portions 15, 16 project substantially in middle and substantially back positions of the taller portions of the partition walls 5 along the lengthwise direction of the partition walls 5. The lower surfaces of the respective locking portions 15, 16 act as locking surfaces, whereas the upper surfaces thereof are slanted to form guide surfaces.

Figure 3:
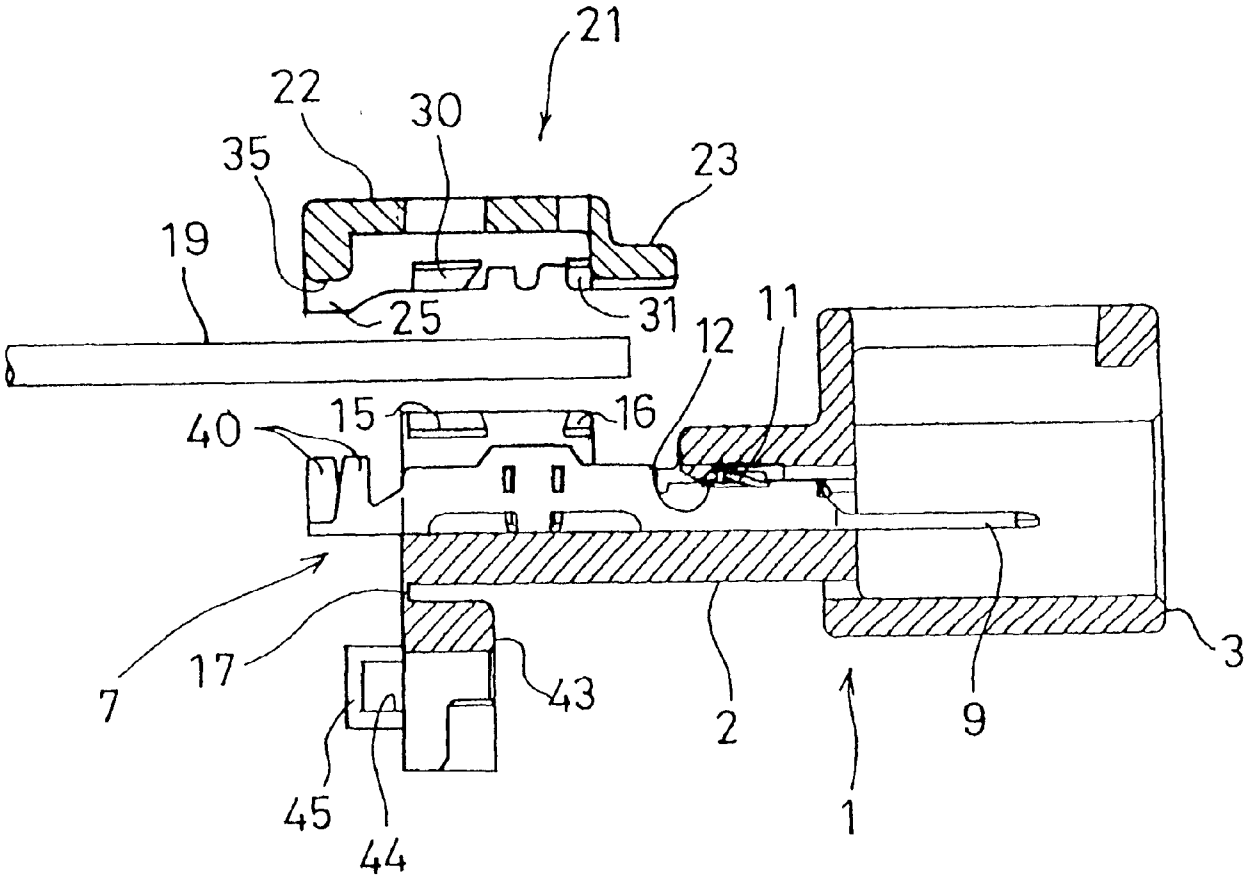
FIG. 3 is a side view in section of the connector when terminal fittings are mounted in a housing with the cover in its open position.

A hinge 17 is provided at the rear end of the bottom surface of the main body 2, and a cover 43 is connected with the main body 2 via the hinge 17. Thus, the cover 43 is pivotal between an open position where the rear end 2A of the main body 2 is exposed as shown in FIG. 3 and a substantially closed position where the coves 43 is pivoted such that it preferably extends substantially continuously with the rear end of the main body 2 as shown in FIG. 1. It should be noted that the housing 1 is molded from resin in such a state where the cover 43 is in its open position, and the terminal fittings 7 are mounted in the housing 1 in this state. In FIG. 1, the cover 43 is shown in its closed position for the sake of convenience. If the cover 43 is in its open position when the terminal fittings 7 are mounted in the housing 1, spaces at the left, right and lower sides of the insulation barrels 40 are exposed to open access paths along which the anvil 41 and the crimper 42 are moved toward the insulation barrels 40 in opposite directions from below and above, respectively.

Locking pieces 45 are formed at the left and right side walls of the cover 43. Each locking piece 45 has a locking hole 44 and projects in such a manner as to be elastically deformable along a transverse direction. The locking pieces 45 are engageable with engaging portions 46 that project from the left and right side walls of the main body 2 to hold the cover 43 substantially in its closed position. Further a cut is made at an upper edge of the rear end of each partition wall 5 of the cover 43. By these cuts, stepped portions 33 having a shorter vertical dimension and are formed at the rear ends of the partition walls 5.

Figure 2:
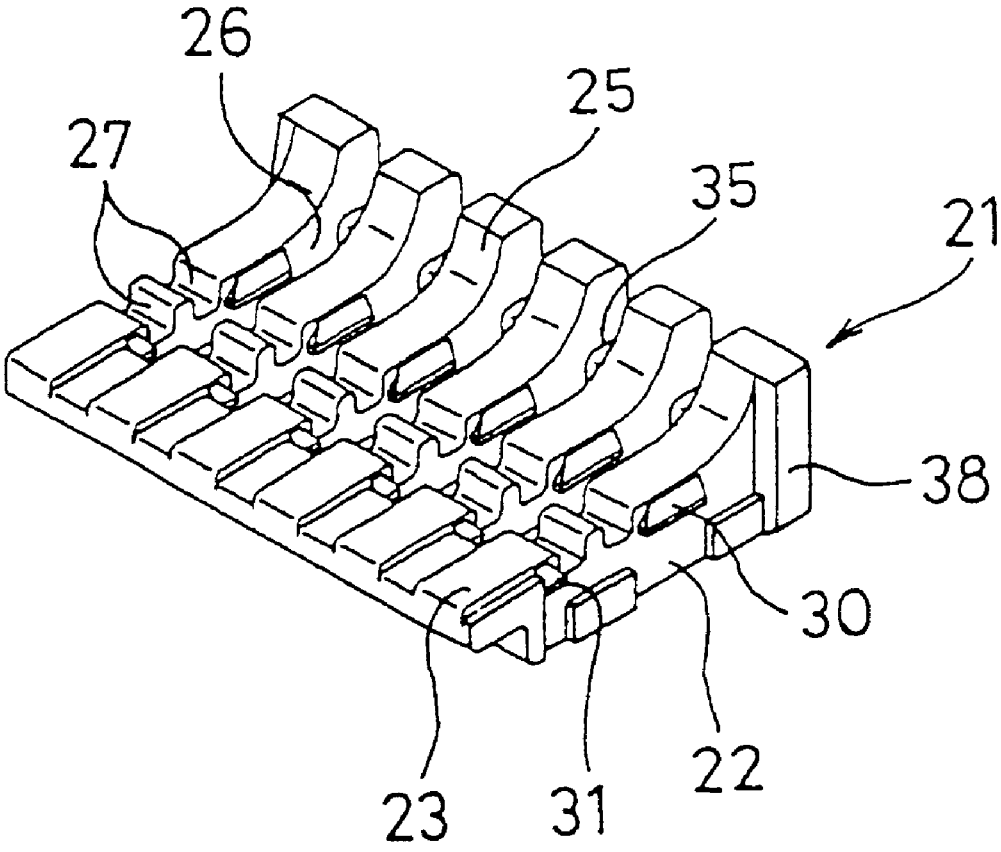
FIG. 2 is a perspective view showing the underside of a lid.

The lid 21 is made e.g. of a synthetic resin material and is shaped such that it can substantially cover the opening 14 in a portion 2B, which preferably is the upper surface of the main body 2 of the housing 1. The lid 21 is comprised of a main body 22 and a fittable plate 23, which is provided at the front end of the main body 22 and is placeable on the lower portions of the partition walls 5 in the opening 14. As shown in FIG. 2, the same number of pressing portions 25 as the cavities 4 are formed on the lower surface of the main body 22 with an escape groove 26 for avoiding the interference with the partition walls 5 of the housing 1 provided between each pair of adjacent pressing portions 25. The pressing portions 25 are individually fittable into the corresponding cavities 4. Further, escape recesses 27 for avoiding the interference with the upper ends of the blades 10 of the terminal fittings 7 are formed in the lower surfaces of the respective pressing portions 25. Opposite side surfaces of the bottom end of each pressing portion 25 have long and short engaging portions 30, 31 which project in middle and back positions with respect to the lengthwise direction. The upper surfaces of the respective engaging portions 30, 31 act as locking surfaces, and the lower surfaces (upper surfaces in FIG. 1) thereof are slanted to form guide surfaces. Accordingly, as described later, when the lid 21 is pushed on the housing 1, the engaging portions 30, 31 of the lid 21 move over locking portions 15, 16 of the housing 1 and are engaged below them. As a result, the lid 21 and the housing 1 are locked into each other. Further, a shallow groove portion 35 having a smaller depth (having a lower ceiling surface) substantially corresponding to the stepped portion 33 of the housing 1 is formed at the rear end of each escape groove 26 between the pressing portions 25.

As shown in FIG. 1, bulging portions 38 bulge outwardly at the left and right side surfaces of the rear end of the lid 21, whereas insertion grooves 39 into which the bulging portions 38 are insertable are formed in the outer surfaces of the entrances of the cavities 4 located at the opposite ends of the housing 1.

Next, the action and effects of this embodiment constructed as above are described. First, the terminal fittings 7 are inserted into the respective cavities 4 of the housing 1 preferably from behind with the cover 43 left in its open position (FIGS. 3 and 4), and locked by the engagement of the locking portions 11 with the engaging portions 12. Subsequently, the wires 19 are inserted into the cavities 4 through the opening 14 from above, and the leading ends thereof are placed on the upper surfaces of the pairs of the blades 10 of the corresponding terminal fittings 7. Here, a pushing jig (not shown) is inserted into the respective cavities 4 to push the wires 19 toward the bottom surfaces of the terminal fittings 7. As a result, the insulation coatings 19A of the wires 19 are cut in two positions displaced along forward and backward directions by the blades 10, thereby electrically connecting the cores 19B of the wire 19 with the terminal fittings 7.

Figure 4:
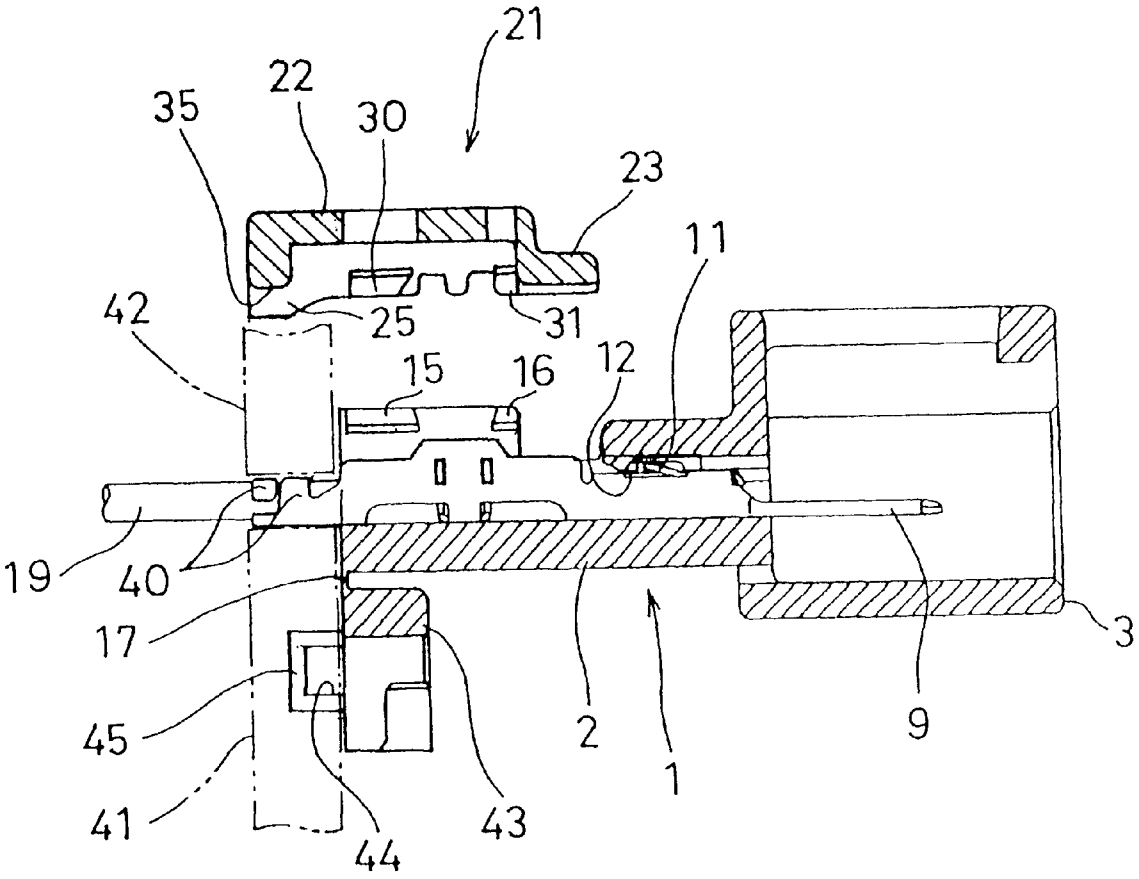
FIG. 4 is a side view in section of the connector when wires are connected with the terminal fittings.
Figure 5:
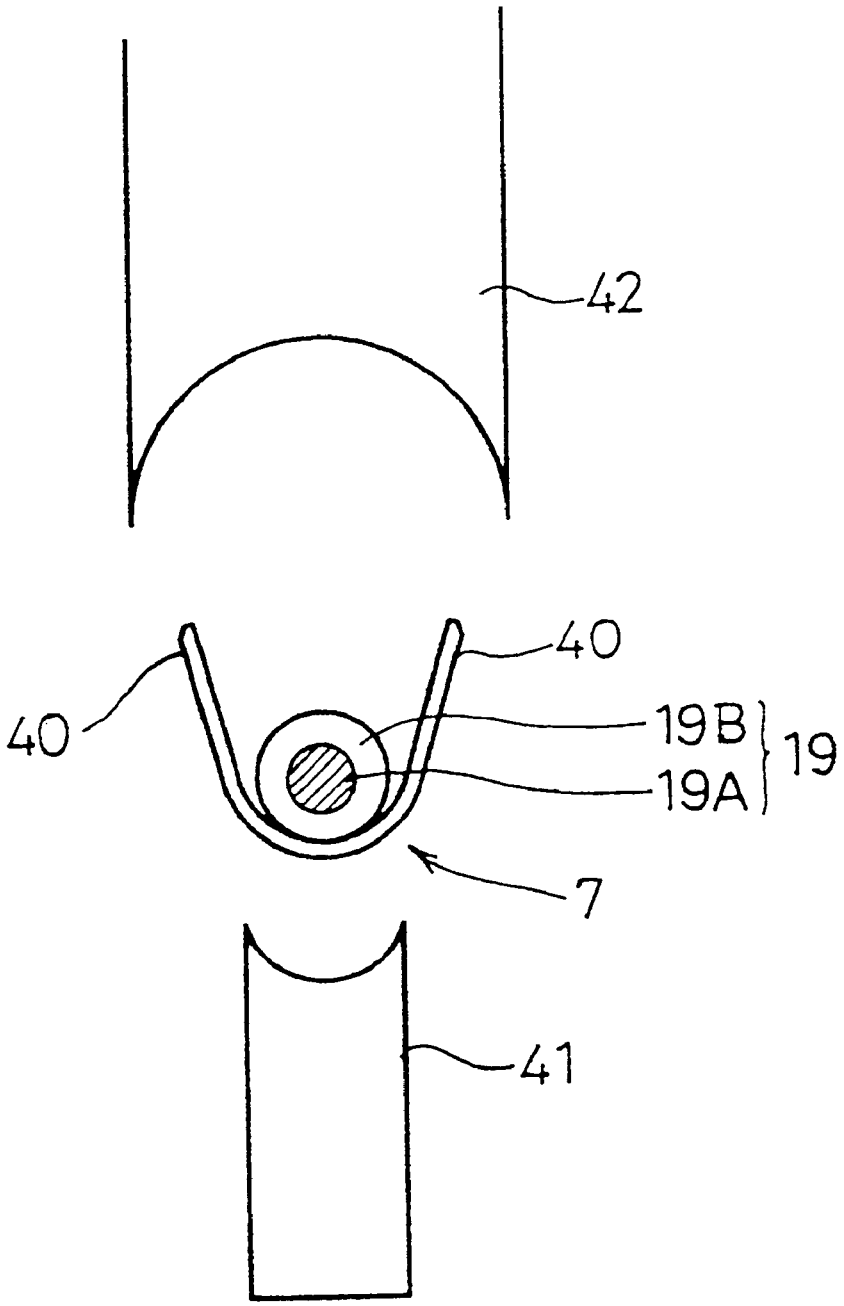
FIG. 5 is an enlarged partial rear view showing a state before insulation barrels are crimped by an anvil and a crimper.
Figure 6:
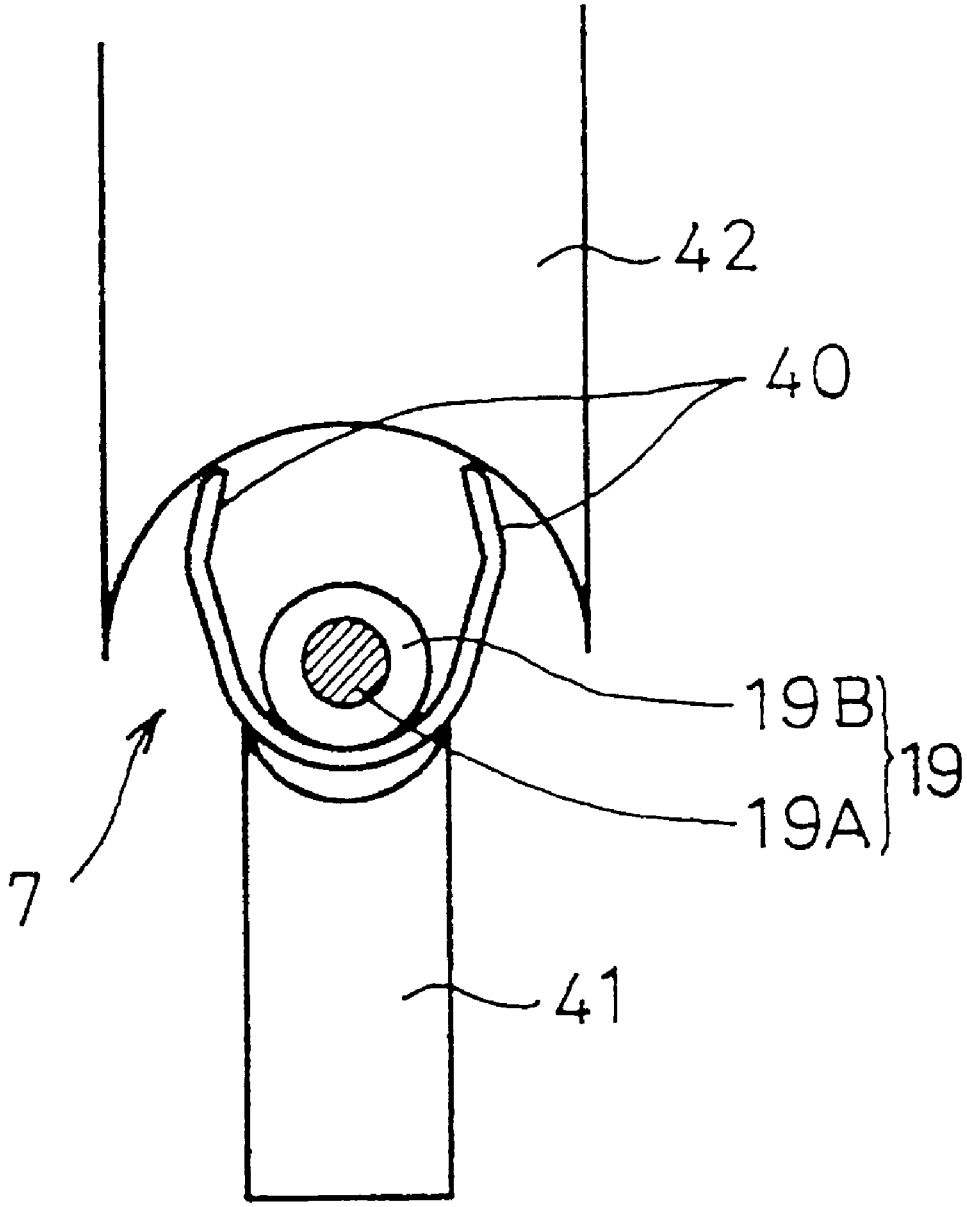
FIG. 6 is an enlarged partial rear view showing a state while the insulation barrels are being crimped by the anvil and the crimper.
Figure 7:
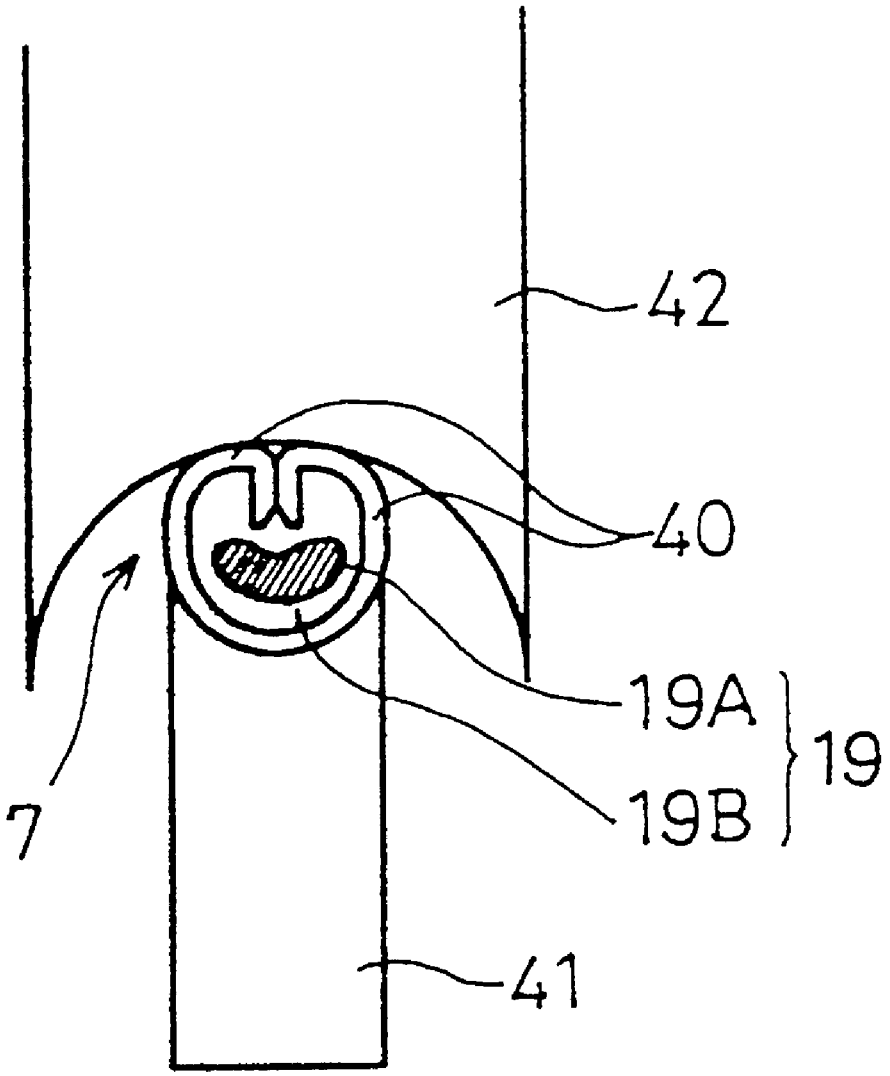
FIG. 7 is an enlarged partial rear view showing a state after the insulation barrels are crimped by the anvil and the crimper.
Figure 8:
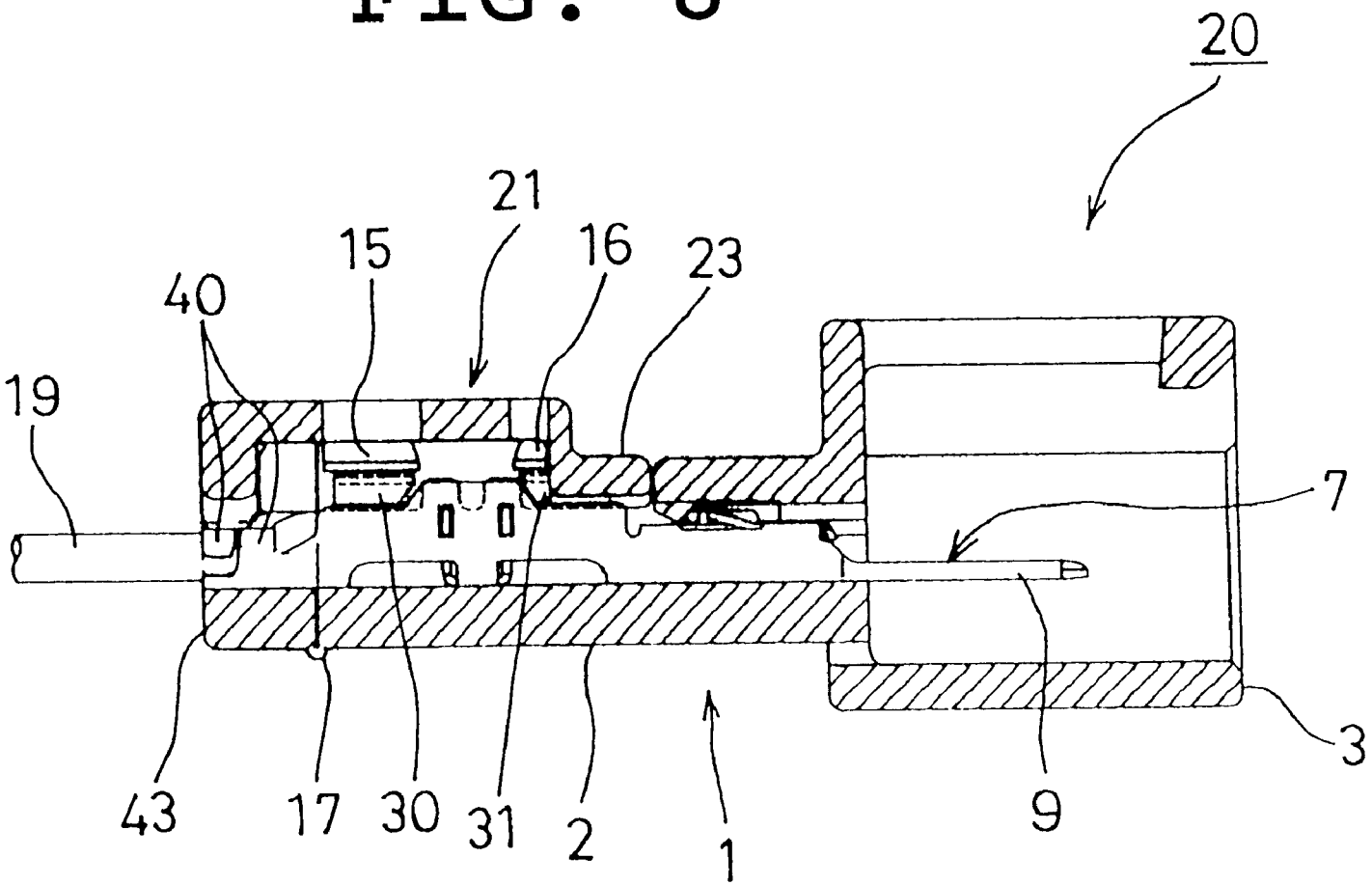
FIG. 8 is a side view in section of the assembled connector.

Next, the insulation coatings 19A of the wires 19 are connected with the insulation barrels 40 by the anvil 41 and the crimper 42 as shown in phantom of FIG. 4 and in FIGS. 5 to 7. In other words, the wires 19 are placed between the corresponding pairs of the insulation barrels 40, and the anvil 41 and the crimper 4 are moved toward them in opposite directions from below and above, respectively (see FIG. 5). Subsequently, the upper ends of the insulation barrels 40 are compressed by the crimper 42 while the lower surfaces of the terminal fittings 7 are held by the anvil 41

(see FIG. 6). When the crimper 42 is pushed to a predetermined position, the insulation barrels 40 are crimped to secure the insulation coatings 1 of the wires 19 to the terminal fittings 7 (see FIG. 7).

Subsequently, the cover 43 is rotated or pivoted toward its closed position. During this rotation, the locking pieces 45 come into contact with the engaging portions 46, thereby being elastically deformed outwardly. When the cover 43 is rotated further, the engaging portions 46 interact, preferably are fitted into the locking holes 44 and the locking pieces 45 are elastically restored to their original shapes. a result, the cover 43 is locked in its closed position.

Finally, the lid 21 is mounted in the opening 14 in the upper surface of the housing 1. The lid 21 is pushed while the partition walls 5 are fitted into the escarie grooves 26 and the guide surfaces of the engaging portions 30, 31 of the lid 21 come into contact with the guide surfaces of the locking portions 15, 16 of the housing 1 at an intermediate stage of the mounting operation. When the lid 21 is pushed further, the engaging portions 30, 31 of the lid 21 move over the locking portions 15, 16 of the housing 1 to be engaged therewith. As a result, the lid 21 is locked in its proper mount position (see FIG. 8).

According to this embodiment, since the cover 43 is left in its open position when the terminal fittings 7 are accommodated in the cavities 4, the portions of the walls of the housing 1 which may interfere the access paths of the crimper 42 and the anvil 41 are open over the substantially entire width W. Thus, the housing 1 can easily avoid interference with the crimper 42 and the anvil 41 as compared with a housing which is made open on the access paths of the crimper 42 and the anvil 41 by individually forming a hole for each cavity. Since this is advantageous when the intervals between the cavities 4 are narrowed, the housing 1 can be made smaller.

This embodiment is easier to handle and more advantageous in terms of costs due to a reduced number of parts, as compared with a case where the access path anvil 4 is closed by a separate cover.

In addition, the insulation barrels 40 are crimped by causing the crimper 42 and the anvil 41 to act directly thereon in this embodiment. Since the crimping force acts via the floor surface 131A in the prior art connector, it does not directly act on the terminal fitting 111, which may cause an error and a variation in the crimped state of the insulation barrels 114. According to this embodiment, such an event can be avoided.

Although the lid 21 and the housing 1 are separate parts in this embodiment, the lid 21 may be integrally formed with the housing 1 by rotatably connecting the front end of the lid 21 with the housing 1 via a hinge. Then, the connector can be more satisfactorily handled since the number of parts is reduced.

Figure 9:
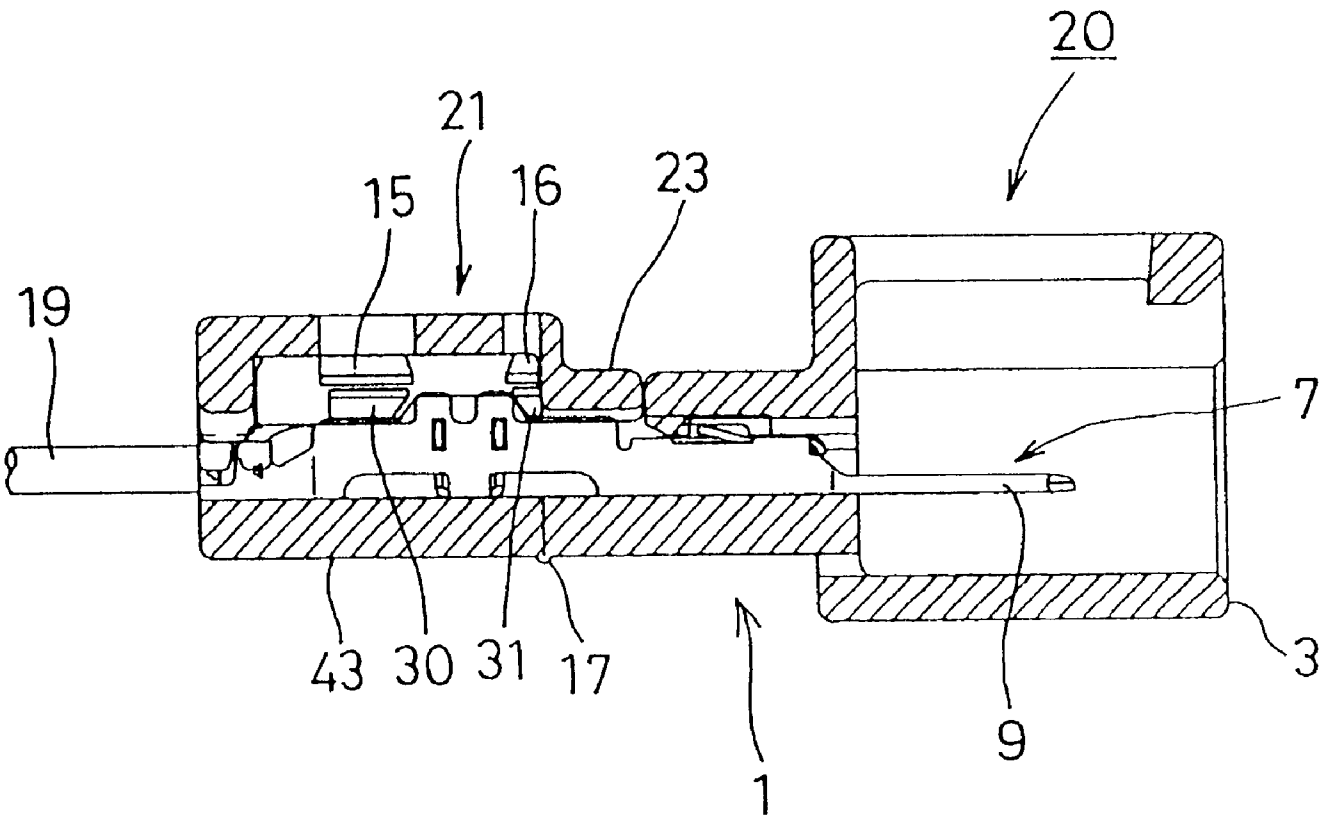
FIG. 9 is a side view in section of a connector according to a modification of the first embodiment.

FIG. 9 shows a modification of the first embodiment. In this example, the hinge 17 is provided in the vicinity of the middle of the main body 2. With such a hinge 17, if the cover 43 is in its open position when the terminal fittings 7 are mounted in the cavities 4, the lower surfaces of the blades 10 are also exposed to the outside. Thus, the jig can be brought into direct contact with the lower surface of the blades 10 when the wires 19 are pushed into the blades 10, thereby ensuring a more secure pushing operation.

Figure 10:
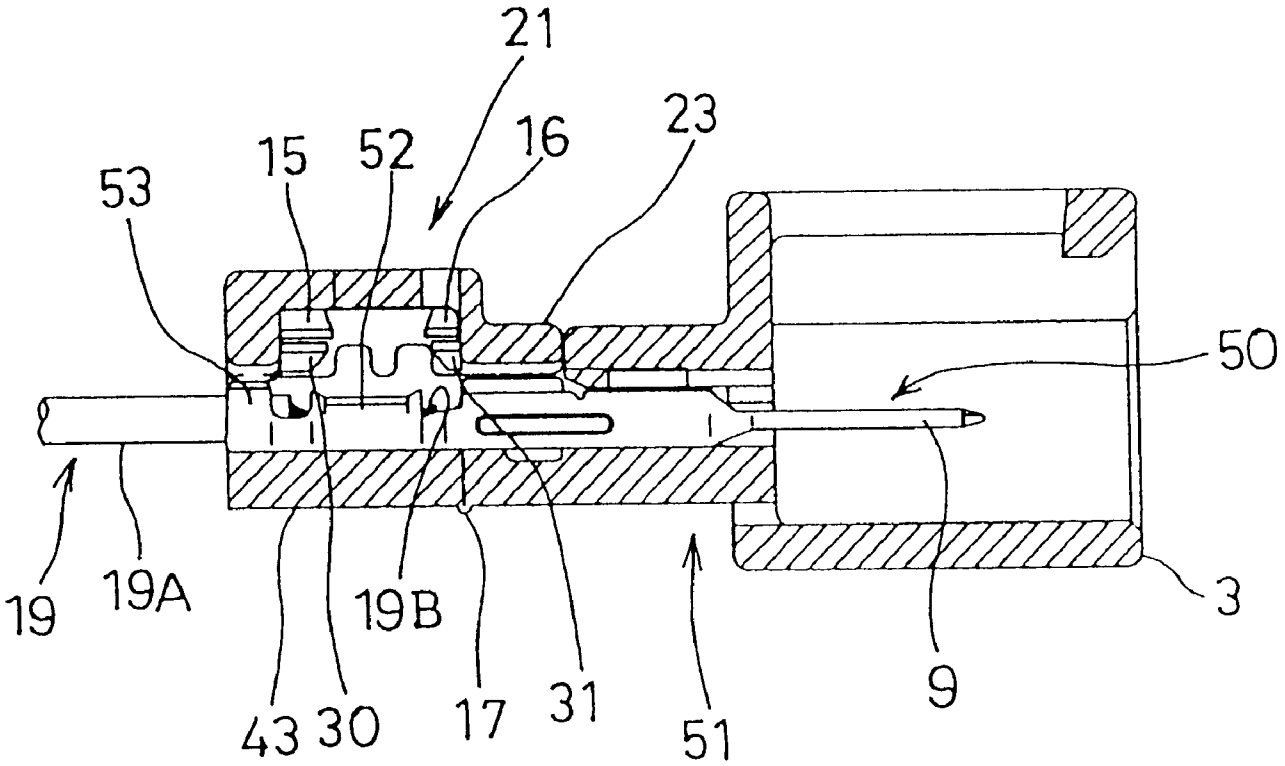
FIG. 10 is a side view in section of a connector according to another embodiment.
Figure 11:
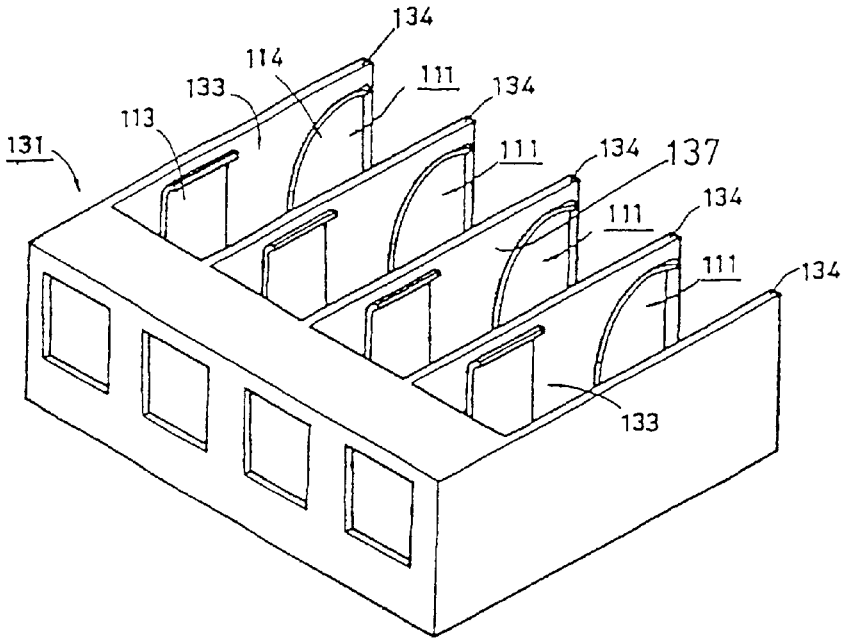
FIG. 11 PRIOR ART
FIG. 11 is a perspective view of a prior art housing having terminal fittings mounted therein.
Figure 12:
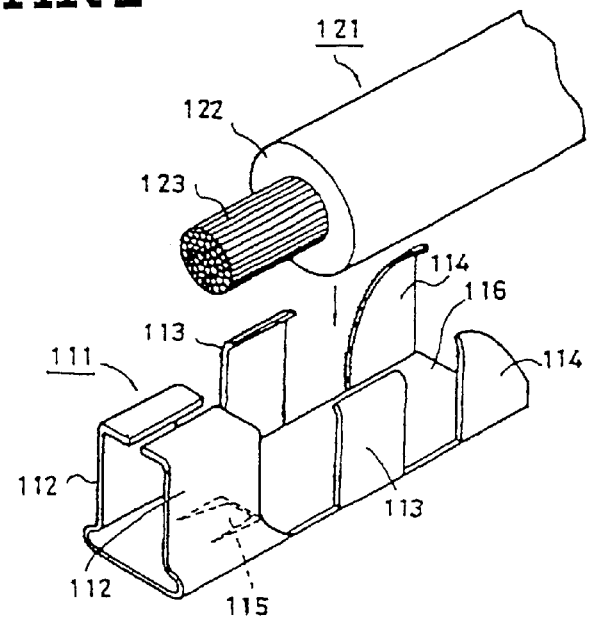
FIG. 12 PRIOR ART
FIG. 12 is a perspective view showing a state before a wire is mounted in the prior art terminal fitting.
Figure 13:
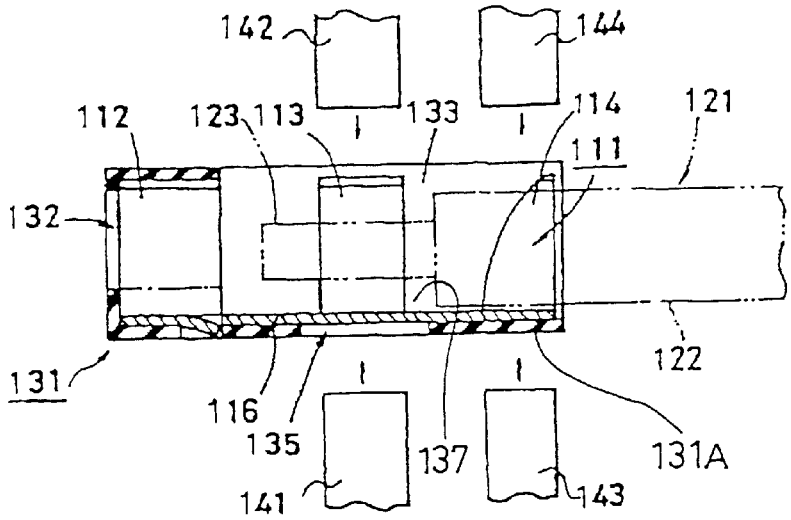
FIG. 13 PRIOR ART
FIG. 13 is a side view in section showing an intermediate stage of a assembling operation of a prior art connector before the wires are connected with the terminal fittings by an anvil and a crimper.
Figure 14:
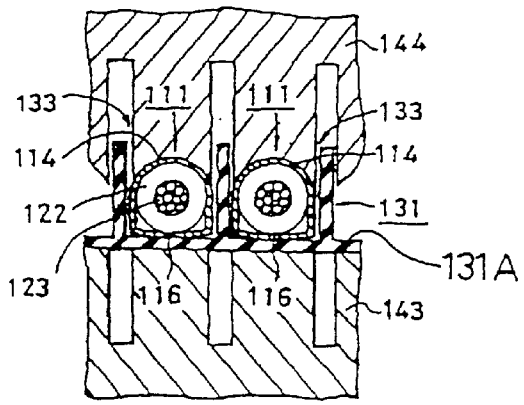
FIG. 14 PRIOR ART
FIG. 14 is a section showing an insulation barrel crimping operation during the assembling operation of the prior art connector.
Figure 15:
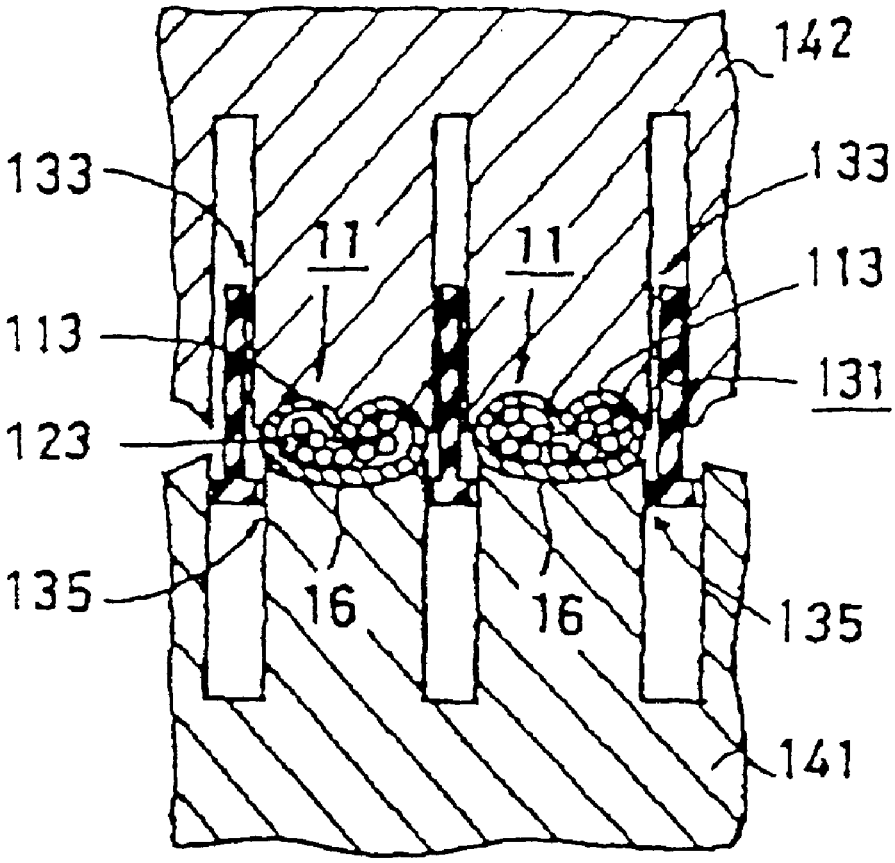
FIG. 15 PRIOR ART
FIG. 15 is a section showing a wire barrel crimping operation during the assembling operation of the prior art connector.

FIG. 10 shows an embodiment of the present invention applied to a housing 51 in which crimping type terminal fittings 50 are mountable. It should be noted that no description is given on substantially the same or similar construction in FIG. 10 as the first embodiment by identifying it by the same reference numerals.

The terminal fitting 50 has a pair of wire barrels 52 and a pair of insulation barrels 53 displaced along forward and backward directions. The wire barrels 2 located in a forward position are crimped to be connected with a core 19B of a wire 19, which is exposed by removing a portion of an insulation coating 19A at one end of the wire 19. Further, the insulation barrels 53 located in a backward position are crimped to be connected with the insulation coating 19A.

A hinge 17 is located more forward or at a distance with respect to the longitudinal direction of the terminal fitting 50 than the wire barrels 52 when the terminal fittings 50 are mounted in the housing 51. When a cover 43 is in its open position, the barrels 52, 53 are both exposed behind the housing 51, thereby enabling access of an anvil and a crimper (which are not shown, but have the same or similar constructions as those described in the first embodiment) from substantially opposing positions below and above the housing 51.

The embodiment thus constructed has substantially the same action and effects as the first embodiment.

The present invention is not limited to the foregoing embodiments. For example, the following embodiments are also embraced by the technical scope of the present invention as defined in the claims.

The cover may be a separate part from the housing instead of being integrally formed with the housing.

The present invention can also be applied to connectors in which female terminal fittings are mountable.

What is claimed is:

1. A connector, comprising:

terminal fittings each having opposite front and rear ends, the front end being configured for malting with another connector, the rear end comprising insulation barrels configured for crimped connection with an insulation coating of a wire, and a connector housing having opposite front and rear ends and formed with a plurality of cavities extending between the ends for accommodating the terminal fittings, the cavities being dimensioned such that at least the insulation barrel of the respective terminal fittings project beyond the rear end of the connector housing when the terminal fittings are accommodated in the respective cavities, and a cover hingedly connected to the rear end of the connector housing and rotatable from an open position where said cover is spaced forwardly of the insulation barrels of the terminal fittings and a closed position where said cover partly surrounds said insulation barrel.

2. A connector according to claim 1, wherein the cover has a lock for locking the cover in its closed position.

3. A connector according to claim 1, wherein each said terminal fitting has a connector portion disposed between the front and rear ends of the respective terminal fitting for connection with a core of the respective wire, the connector housing being open in positions corresponding to the connecting portions of the terminal fittings connected with the cores of the wires, a lid being configured for covering the open portions of the connector housing over the connecting portions of the terminal fittings.

4. A connection method for connecting terminal fittings with wires and accommodating the terminal fittings in cavities of a connector, comprising the steps of:

providing a connector housing with opposite front and rear ends and cavities extending between the ends, the connector housing further having a cover hingely connected to the rear end of the connector housing, the cover being hingedly movable from an open position where the cover is spaced forwardly of the rear end of the connector housing to a closed position where the cover defines an extension of the cavities rearwardly from the rear end of the connector housing;

providing a plurality of terminal fittings, each said terminal fitting having opposite front and rear ends, the rear end of each said terminal fitting comprising crimpable insulation barrels;

providing a plurality of wires, each said wire having a core and an insulation coating surrounding the core;

inserting the terminal fittings into the respective cavities with the cover in the open position, such that the insulation barrels of the terminal fittings project rearwardly beyond the rear end of the connector housing;

inserting the wires in the respective terminal fittings;

moving a crimper and an anvil towards each other for directly engaging and crimping the insulation barrels to effect connection of the wires with the insulation barrels of the respective terminal fittings with the terminal fittings accommodated in the corresponding cavities; and hingedly rotating the cover to the closed position for at least party accommodating the crimped barrels by the cover.

5. The connection method of claim 4, wherein the terminal fittings are insulation displacement terminal fittings and have insulation displacement blades there in, and where the step of inserting the wires into the terminal fittings comprises urging the respective wires into the insulation displacement blades for achieving contact between he insulation displacement blades and the cores of the respective wires and simultaneously placing the wires in proximity to the insulation barrels.

6. The connection method of claim 4, further comprising steps of providing a lid dimensioned for covering the rear end of the connector housing and the cover, and mounting the lid to the connector housing and to the cover after rotating the cover to the closed position.

7. A connector according to claim 1, wherein the connector housing an the cover are unitarily formed.

* * * * *